US007852285B2

(12) United States Patent
Tennagels

(10) Patent No.: US 7,852,285 B2
(45) Date of Patent: Dec. 14, 2010

(54) DISPLAY DEVICE COMPRISING A HOLDING MEMBER

(76) Inventor: Thomas Tennagels, Kirchstrasse 22, Duesseldorf (DE) 40227

( * ) Notice: Subject to any disclaimer, the term of this patent is extended or adjusted under 35 U.S.C. 154(b) by 381 days.

(21) Appl. No.: 12/074,484

(22) Filed: Mar. 4, 2008

(65) Prior Publication Data

US 2008/0218370 A1 Sep. 11, 2008

(30) Foreign Application Priority Data

Mar. 9, 2007 (DE) ..... 10 2007 011 986

(51) Int. Cl.
*G09G 5/00* (2006.01)

(52) U.S. Cl. ..... 345/1.3; 340/815.4; 340/815.45; 345/1.1

(58) Field of Classification Search ..... 340/815.4, 340/815.45, 815.49; 345/1.3, 1.1
See application file for complete search history.

(56) References Cited

U.S. PATENT DOCUMENTS

2002/0126064 A1* 9/2002 Yen ..... 345/5
2004/0046678 A1 3/2004 Grady

FOREIGN PATENT DOCUMENTS

DE 200122329 11/2001
DE 20-2004-014145 9/2004
DE 20122329 U1 5/2005
DE 102004014145 U1 12/2005
EP 1293955 11/2001
EP 1293955 A2 * 3/2003
ES 2261018 A1 1/2006
JP 9134141 A 5/1997

OTHER PUBLICATIONS

2005 Eddy Awards; Lighting Product of the Year; G-LEC Europe GmbH; industriestrasse 4b;76470 Otigheim, Germany.
G-LEC Marketing Brochure for "Tube" Display dated Mar. 28, 2006; G-LEC Europe GmbH; industriestrasse 4b;76470 Otigheim, Germany.
2005 EDDY Awards; Lighting Product of the Year; brochure; Mar. 28, 2006; 4 pages; G-LEC Europe GmbH; Otigheim, Germany.
G-LEC Europe GMGH; Tube; brochure; Mar. 28, 2006; 4 pages, G-LEC Europe GMBH, Otigheim, Germany.

* cited by examiner

*Primary Examiner*—Travis R Hunnings
(74) *Attorney, Agent, or Firm*—Clements Bernard; Gregory N. Clements

(57) ABSTRACT

A display device for presenting optic content, comprises a holder device and a plurality of rod-shaped display elements, said display elements comprising a plurality of illuminants. The display elements are held by the holder device and a display area for presenting the optic content is formed by the plurality of display elements. The holder device comprises a plurality of holder elements interconnected by connecting devices such that the holder device is variable in shape, so that a variation of the shape of the holder device allows for the variation of the shape of the display area. The invention is characterized in that the holder device holds the display elements only at a first end of the latter.

24 Claims, 4 Drawing Sheets

DISPLAY DEVICE COMPRISING A HOLDING MEMBER

BACKGROUND OF THE INVENTION

RELATED FOREIGN APPLICATION

The present application claims the priority of the German Patent Application No. 10 2007 011 968.2 of Mar. 9, 2007, the disclosure of which is herewith incorporated herein by reference.

FIELD OF THE INVENTION

The invention refers to a display device for presenting optical content, such as used especially in big events.

DESCRIPTION OF RELATED ART

Such display devices are typically designed as LED display surfaces. Here, a plurality of LED's are arranged in parallel in several, generally vertical rows. The optical content is represented by a controlled activation of individual LED's.

European Patent 1 293 955 describes a display device having a number of LED tubes wherein a certain number of LED tubes is comprised in respective display panels. These display panels comprises a frame structure along their entire periphery, in which the LED tubes are held. The frame structure further serves to receive a control for the display device. Depending on the position of an individual display panel in the entire display device, the frame structure of the panel comprises hinge members via which the individual display panels are interconnected at their respective frames. This makes it possible to arrange a plurality of display panels above each other or side by side in a simple manner, so that the display device can take different shapes.

It is a drawback of such a display device that the display device cannot take any optional geometric shape. The outer contour of the display device can be modified only to the extent allowed by the size of the frame structures of the display panels. Since it is not feasible under aspects of costs and structural aspects to provide a very large number of display panels with very small frame structures, the display device described has a very limited adaptability to requirements imposed by the environment or to design requirements.

SUMMARY OF THE INVENTION

It is an object of the present invention to provide a display device which is easily adapted to a respective environment, or to design aspects.

A display device for presenting optical content, especially for big events, comprises a holder device and a plurality of rod-shaped display elements. The display elements include a plurality of illuminants that may be designed as LED's or LED clusters, for example. The rod-shaped display elements may be formed by transparent tubes within which the illuminants are arranged. The display elements are retained by the holder device. The plurality of display elements thus forms a display area for presenting optical content.

The holder device comprises a plurality of holder elements interconnected by connecting means, such as connecting hinges, for example, such that the shape of the holder device becomes variable. Thus, the holder device need not extend linearly, but may have a sinuous shape, for example. A variation of the shape of the holder device also allows for a variation of the shape of the display area formed by the display elements. It is an essential feature of the invention that the rod-shaped display elements are retained by the holder device only at a first end of the display elements. For example, it is possible to arrange the holder device above the display elements, seen in the direction of gravity, so that the display elements are suspended from the holder device.

Thus, it is possible to determine the length of the individual display elements, which are usually arranged in parallel rows, individually for each row without having to modify the holder device. In this manner, a LED curtain may be designed which has an irregular shape and can thus be adapted to different environments. It is further possible to give the display device a very flexible structure with respect to design aspects.

Besides an adaptation of the outer contour of the display device, as described above, it is also possible to change the shape of the display area by changing the shape of the holder device. To accomplish this, the holder device comprises a plurality of holder elements which are hingedly connected with each other, for example, so that the holder device does not necessarily have to be a straight support rail. Rather, the holder device may have a chain-like structure, the individual holder elements being formed as the links of the chain. Thus, the holder device is structured as a multi-link support bar, where the individual links of the support bar are formed by the holder elements. This variability of the shape of the holder device makes it possible to readily make further adaptations to the respective environment or to design aspects.

For a simpler adaptation of the length of the individual display elements, it is preferred that the same comprise display element segments, where, in particular, a plurality of display element segments forms a display element. A display element segment may be designed as a transparent support tube, in which a plurality of LED's are arranged in succession on a circuit board. The ends of the display element segments are preferably provided with plug means for a detachable electrical and/or mechanical interconnection of the display element segments. Hereby, the display element segments may be interconnected in a simple manner, the connection being very quickly made and detached.

It is particularly preferred to arrange the holder device exclusively on a first side of the display elements situated at a first end of the rod-shaped display elements. Accordingly, the holder device is not a frame structure embracing the display elements along their entire periphery. Contrary thereto, the holder device is arranged only on one side of the display elements, the three other sides of the display elements comprising no holder device. If, for example, the holder device is provided above the display elements, no further holder device is provided on the left and right sides, as well as on the bottom side of the display elements. Accordingly, such a display device is of a simplified construction when compared to previously known frame structures. For creating a particularly high display device, it is not necessary to interconnect a plurality of frame structures one above the other. It is sufficient to merely plug together a plurality of display element segments to form one or a plurality of display element rows having the desired length, where after the same may be suspended from a holder device arranged above the display elements, for example. Such a device makes it possible to easily build a display area of more than 7 m in height, for example. The required mechanical stability of the display elements may be guaranteed, for example, by transparent tubular support elements. These may be connected at their bottom side by means of a spacer element so that the preferably parallel display elements always have a constant distance from top to bottom.

In a preferred embodiment, the connecting devices for connecting the plurality of holder elements are configured as connecting hinges. Here, the connecting devices may comprise first and second connecting projections which are formed, in particular, as parts of the holder elements. The holder device may comprise an overlapping portion in the connecting portion of two adjacent holder elements, in which the second connecting projection of a first holder element and the first connecting projection of a second holder element overlap. Here, the connecting hinge may be formed by the second connecting projection of the first holder element and the first connecting projection of the second holder element. A pivot axis may further pass through these connecting projections of two adjacent holder elements, about which the two adjacent holder elements may be pivoted relative to each other. Preferably, this axis extends vertically, but it may also be a horizontal axis.

It is particularly preferred that the holder elements of the chain link type are pivotable relative to each other about a plurality of mutually parallel vertical or horizontal axes. Thus, the holder device can assume an optional geometric shape, just like a chain. This variation simultaneously causes a variation of the shape of the display area of the display device.

As is particularly preferred, the display elements retained in the holder device always have a constant mutual distance. Especially, the distance between two adjacent display elements retained by different holder elements is also equal to the distance between the other display elements.

To allow for a simple holding of the display elements in the holder device, a catch device may be provided which is formed, in particular, by a first catch element at the holder device and a second catch element at the support elements of the display elements. Here, the first and second catch elements cooperate to hold the display elements. In particular, the catch device may be embodied by six-pole XLR connections. The catch device may be manufactured together with the holder device, especially for a simultaneous electric and mechanic connection of the display elements.

In a preferred embodiment of the invention, the holder device comprises a voltage supply device and/or a control device for the display elements. For example, these devices may be accommodated in a housing comprising the holder device.

As an alternative to an arrangement of the holder device above the display elements, seen in the direction of gravity, the holder device may also be arranged below the display elements, seen in the direction of gravity, so that the display elements are set up in the holder device. Here, it is also preferred to provide the top end of the display elements with a spacer element so that the preferably parallel display elements have a constant mutual distance from top to bottom.

For installing the display device, e.g. on a stage, the holder device may include a fastening device for connecting the holder device to a support device, in particular to a suspending device. The suspending device may be a frame structure on a stage, for example. The fastening device may be configured as a gripper clamp embracing the frame structure so that the holder device is rigidly connected with the suspending device, in particular the frame structure. In particular, the fastening device is configured such that individual holder elements may be taken out in a simple and fast manner, e.g. for maintenance purposes.

For an easier adaptation of the length of the individual display elements, it is preferred for the illuminants, such as the LED's on a circuit board of the display elements, have constant mutual distances. Further, the circuit board may be severable between two adjacent illuminants so that the individual display elements or the individual display element segments are variable in their length. Instead of the severed circuit board section, a plug device for a detachable electric and/or mechanic connection with an adjacent display element segment may be provided, the constant mutual distances between the illuminants remaining unaltered.

To achieve a special optic effect, it is possible to provide one side of the display elements, on which no illuminants are provided, with a background material, such as a sheet of textile material, which can be watched by an audience through the display elements. Fastening elements may be provided at the holder device to fasten the background material.

An independent invention refers to a display device for presenting optical content, comprising a plurality of display elements, wherein a first side of the display elements form a first display area and a second side of the display elements forms a second display area. Thus, it is possible, for example, to provide display elements comprising a circuit board having its front face equipped with first illuminants, such as LED's, forming a display area to be looked at from a first direction. On the opposite side of the circuit board, further illuminants may be provided that form a second display area to be viewed from another direction opposite to the first direction.

Especially, it is possible for the illuminants on the first side of the circuit board to show the same content as the illuminants on the opposite side of the circuit board. Alternatively, it is also possible for the illuminants on the first side to show a content different from that shown by the illuminants on the opposite side of the circuit board.

Thus, it is possible, for example, to place the display device in the centre of a room so that the device can be viewed from a plurality of directions. In particular, such a display device allows achieving a three-dimensional design effect. Further, such a display device can be looked at by a larger number of spectators without having to enlarge the dimensions of the display device.

BRIEF DESCRIPTION OF THE DRAWINGS

The following is a detailed description of a preferred embodiment of the invention with reference to the accompanying drawings.

In the Figures.

DETAILED DESCRIPTION OF PREFERRED EMBODIMENTS OF THE INVENTION

Figure 1:
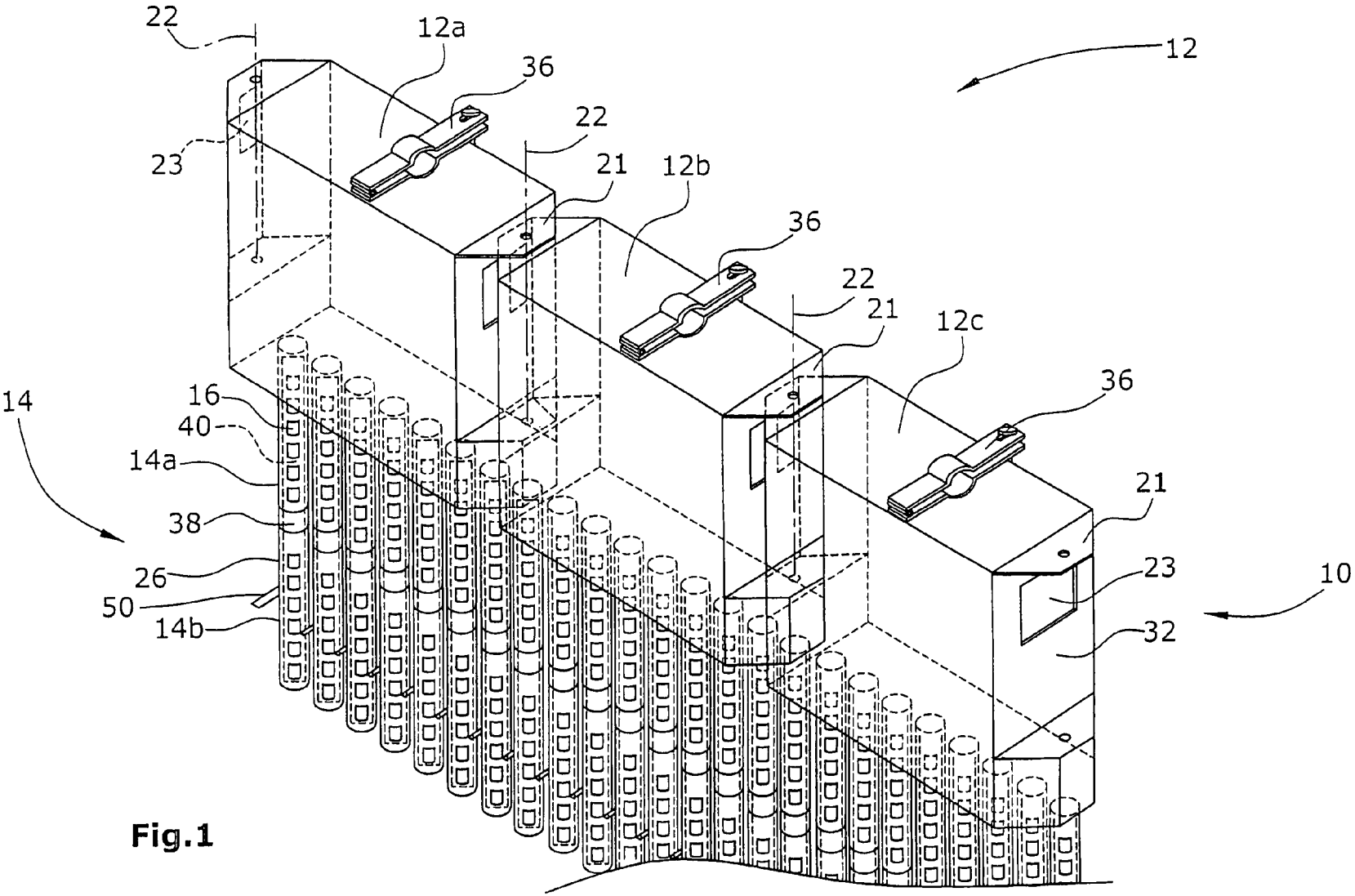
FIG. 1 is a schematic perspective illustration of the display device of the present invention.
Figure 2:
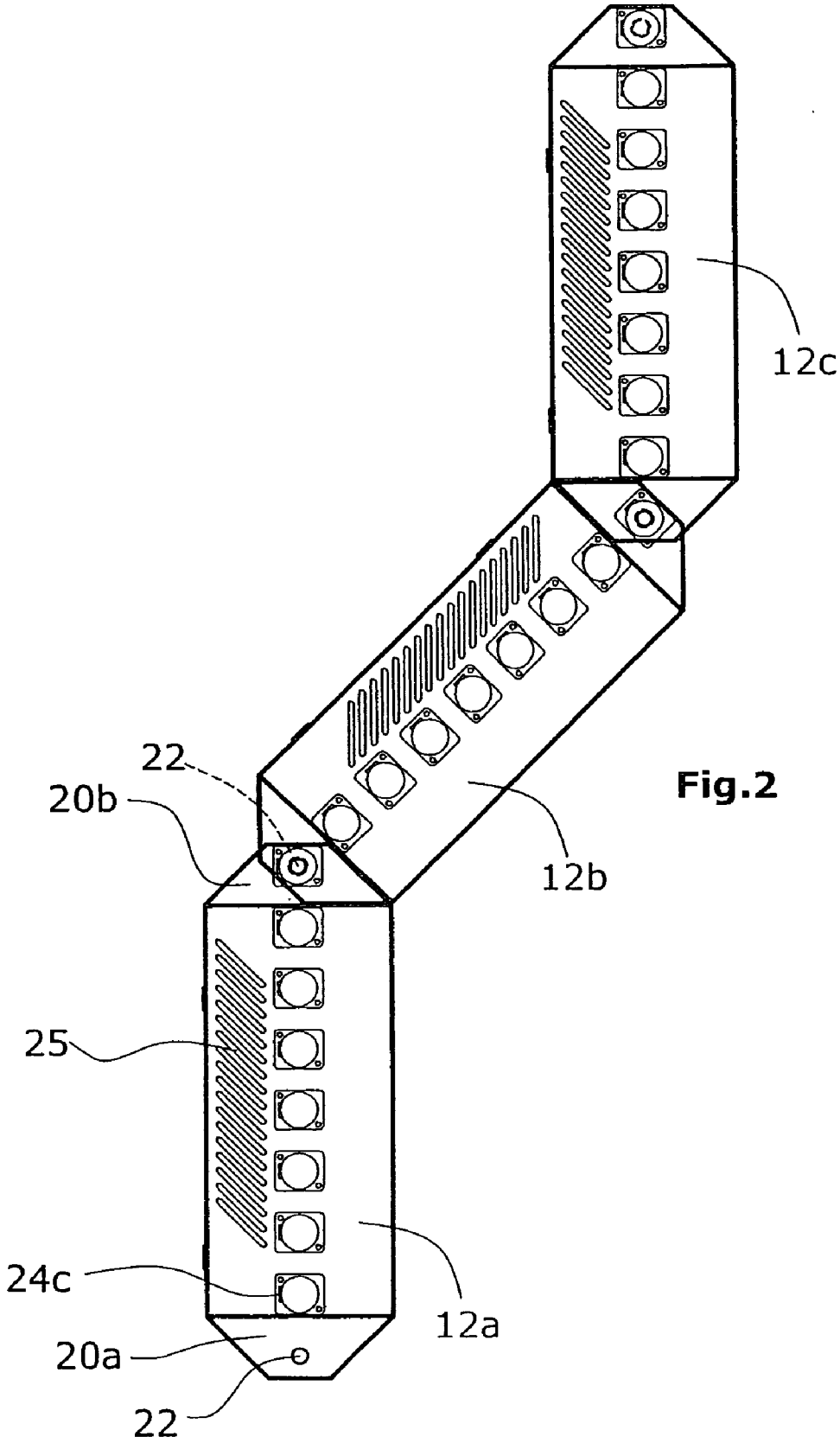
FIG. 2 is a schematic bottom view of the support device according to the present invention.
Figure 3:
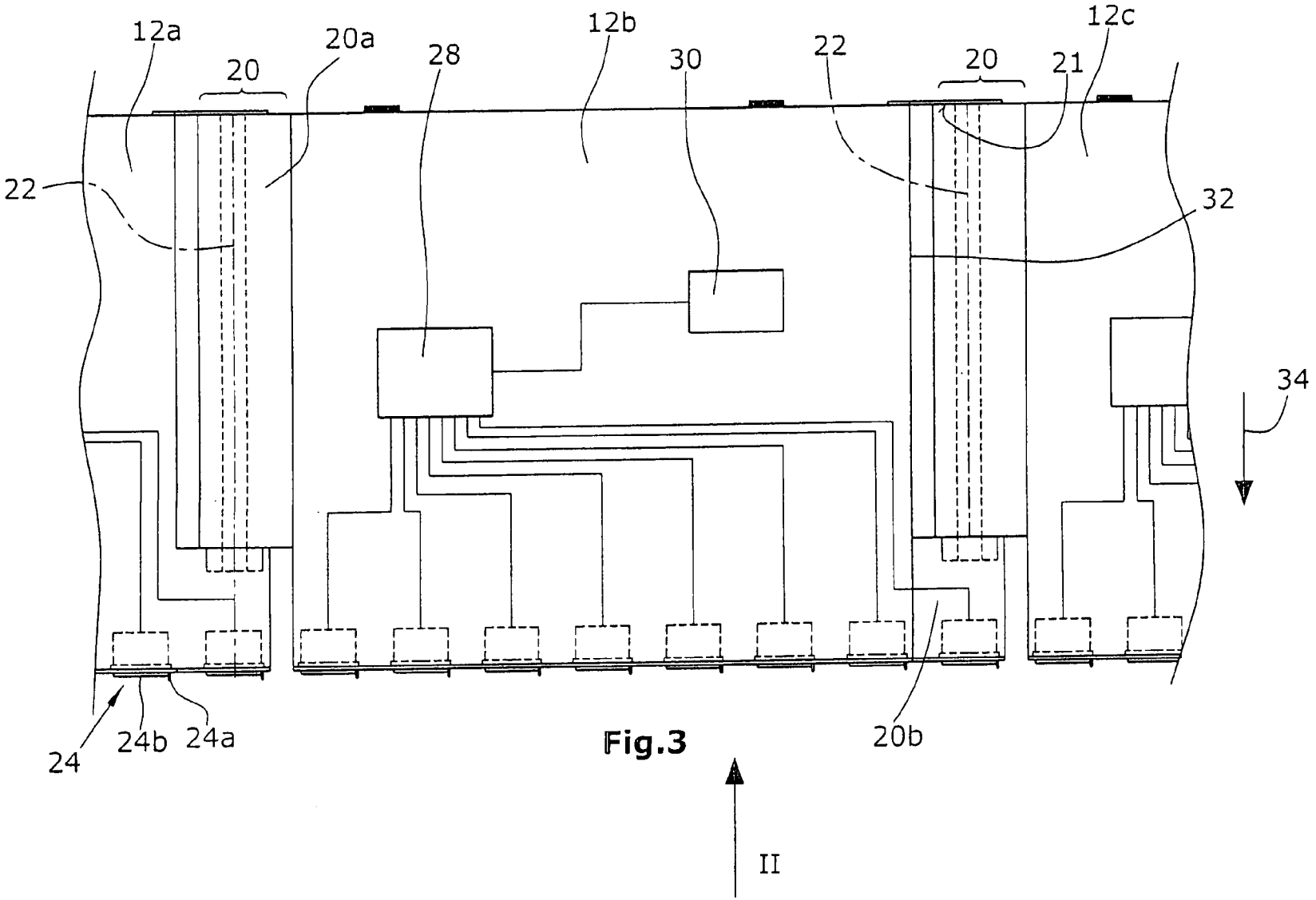
FIG. 3 is a partly sectional schematic side view of the support device of the present invention.

Referring to FIGS. 1 and 3, a display device 10 for presenting optic content comprises a holder device 12 and a plurality of rod-shaped display elements 14. The display elements 14 comprise a plurality of LED's 16 arranged in mutually parallel rows. The display elements 14 are retained by the holder device 12 such that the plurality of parallel display elements 14 form a display area 18 for presenting optic content. The holder device 12 comprises a plurality of holder elements 12*a*, 12*b*, 12*c* similar to chain links, which are connected by connecting hinges 20 such that the holder device 12 is variable in its shape. The connecting hinges 20 are formed by a second connecting projection 20*b* of a first holder element 12*a* and a first connection projection 20*a* of a second holder element 12*b*, the two holder elements 12*a*, 12*b* being arranged adjacent to each other. A real or virtual axis 22 passes through the connecting hinges 20, about which the adjacent holder elements 12*a*, 12*b* may be pivoted relative to each other. The axis 22 extends vertically, i.e. in parallel to the direction of gravity 34.

The display elements 14 are held by the holder device 12 only at a first end of the display elements 14. In the embodiment illustrated, this is the upper end of the display elements 14, seen in the direction of gravity 34. Thus, the display elements 14 are suspended in the holder device 12 and in particular in the holder elements 12*a*, 12*b*, 12.

The link-like holder elements 12*a*, 12*b*, 12*c* are adapted to be pivoted relative to each other about a plurality of parallel vertical axes 22.

Referring to FIG. 3, the display elements 14 are further held in the holder device 12 by means of a catch device 24, the catch device being formed by a first catch element 24*a* at the holder device 12 and a second catch element 24*b* at the transparent tubular support elements 26. Preferably, the catch device 24 is a XLR connection.

In a preferred embodiment, a plurality of LED's 16 may be arranged side by side in a tubular support element 26, the plurality of juxtaposed LED's 16 being adapted to be controlled individually or in common, thereby forming a LED cluster. In all embodiments of the invention, an illuminant, such as a LED 16, may comprise three individual LED's operated according to the RGB principle, for example.

Further, the holder device 12 includes a voltage supply device 28, as well as a control device 30 for the display elements 14. These devices are provided within a housing 32 of the holder device 12.

To achieve a more rigid holding of the display elements 14, the connecting projections 20*a*, 20*b* may be of different height. In particular, it is preferred that the connecting projection 20*b* provided on the side of the holder device 12 where the display elements 14 are held, has a lower height than the connecting projection 20*a* provided on the opposite side. Thus, it can be guaranteed that possible movements of the display elements caused by external forces are not introduced into the holder device 12 by too large a lever.

Preferably, a holder element 12*a*, 12*b*, 12*c* has a web 21 at the top with a bore through which a screw may be passed, for example. This screw may be threaded into a nut integrated into the connecting projection 20*b*, so that the screw assumes the function of the pivot axis 22.

Moreover, the holder elements 12*a*, 12*b*, 12*c* may have recesses 23 in their sides, through which control or voltage supply lines, for example, can be passed from one holder element 12*a* to the next holder element 12*b*. Thus, the individual holder elements 12*a*, 12*b*, 12*c* can be electrically connected in a simple manner. The recesses 23 are preferably formed in the vicinity of the connecting hinges 20. For a better ventilation, the holder elements 12*a*, 12*b*, 12*c* may further have ventilation grids 25 at any optional position.

Referring to FIG. 1, a fastening device 36 is provided for connecting the holder device 12 with a suspension device (not illustrated), e.g. a frame on a stage.

The display elements 14 comprise a plurality of display device segments 14*a*, 14*b* arranged in succession, a display element 14 being formed by a plurality of display element segments 14*a*, 14*b* arranged in succession.

Plug connections 38 for a detachable electric and/or mechanic connection of the display element segments 14*a*, 14*b* with each other are provided at the ends of the display element segments 14*a*, 14*b*. Here, two respective adjacent display element segments 14*a*, 14*b* are connected with each other.

The illuminants 16 of the display elements 14 are arranged on a circuit board 40 which may be located in a tubular support column 26 of plastic material. The illuminants 16 are equidistantly spaced on the circuit board 40. Between two respective adjacent illuminants 16, the circuit board 40 may be cut with a saw, for example, so that the display elements 14 are variable in length. For example, a piece of the circuit board 40 of about 2 cm in length may be cut off and may be replaced with a plug device 38 for a detachable electric connection with another adjacent display element segment 14*a*, 14*b*. Here, the constant mutual distances of the illuminates 16 remain unaltered. To allow the circuit board 40 to be cut at any optional position, it is preferred to have the control and voltage supply lines of the circuit board 40 run uniformly and in parallel. Thus, it can be guaranteed that a plug connector 38, which preferably comprises six different pins, can always make a correct connection with the lines of a severed circuit board 40.

As an alternative, the circuit board 40 may have more or fewer than six parallel lines. Preferably, the electric connection between two adjacent display element segments 14*a*, 14*b* is established using a plug device 38, particularly in the form of an electric plug device. The mechanical connection of two adjacent display elements 14*a*, 14*b* may established by means of a short transparent adapter member (not illustrated) configured like the tubular support elements 26. This adapter member 26 may have a slightly larger diameter than the tubular support elements 26, so that it can be arranged such between two adjacent support elements 26 that the support elements 26 can be inserted into the adapter member from both sides thereof. A fixed mechanic connection between the support elements 26 and the adapter member can be obtained with screws, for example. It is also possible to establish the connection by means of a spring-loaded latch, for example, which may be provided on a support element 26 and which engages in a recess in the edge of the adapter member provided for that purpose.

For the mechanical fastening of the circuit board 40 in the support elements 26, it is further preferred for the circuit board 40 to have regularly spaced bores into which screws may be inserted to mechanically fasten the circuit board 40 to the support elements 26. It is particularly preferred, to arrange these bores at those places in the circuit board where the circuit board is severable for varying its length, as described above.

Referring to FIG. 1, all embodiments of the invention can comprise a spacer element 50 by which the tubular support elements 26 are interconnected, so that the preferably parallel display elements 14 have a constant mutual distance from top to bottom.

Figure 4:
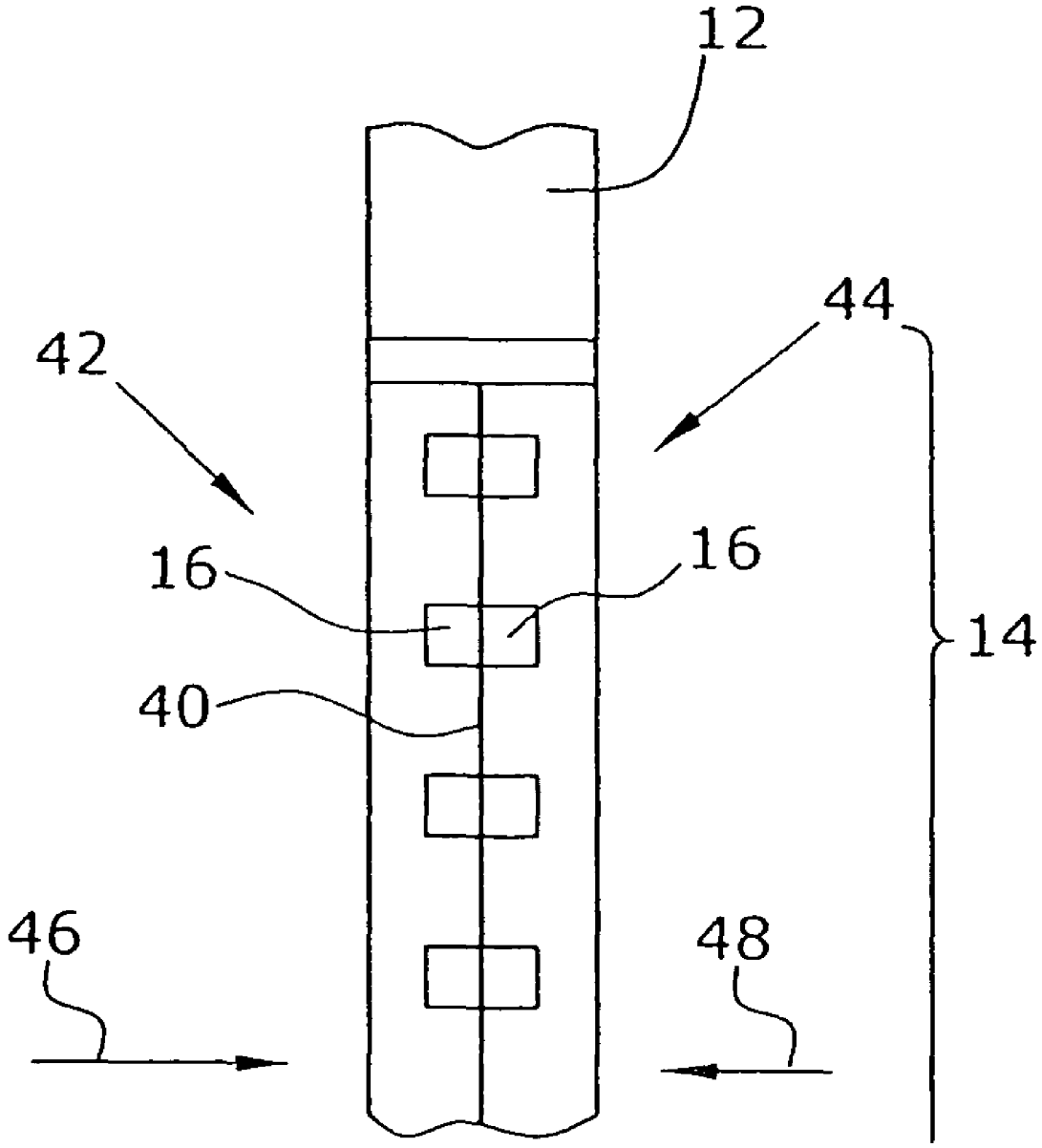
FIG. 4 is a partly sectional schematic side view of an embodiment of the two-sided display device of the present invention.

An independent invention is illustrated in FIG. 4. A display device 10 for presenting optic content and comprising a plurality of display elements 14 is provided, the display elements being arranged side by side and vertically with respect to the plane of FIG. 4. In FIG. 4, the holder device 12 also extends perpendicular to the plane of the drawing. Tubular support elements 26 are provided within which a circuit board 40 is formed. Illuminants 16 in the form of LED's are arranged on both sides of the circuit board 40. The LED's 16 on the first side of the display elements 14 form a first display area 42. The LED's 16 on the second side of the display elements 14 form a second display area 44. The first display area 42 may be viewed from a first direction 46. The second display area 44 may be viewed from a second direction 48 opposite the first direction 46.

Although the invention has been described and illustrated with reference to specific embodiments thereof, it is not intended that the invention be limited to those illustrative embodiments. Those skilled in that art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A display device for presenting optic content, comprising:

a holder device and a plurality of rod-shaped display elements, said display elements comprising a plurality of illuminants, wherein the display elements are held by the holder device and a display area for presenting the optic content is formed by the plurality of display elements, wherein the holder device comprises a plurality of holder elements interconnected by connecting devices in a chain-like structure so that the individual holder elements are formed as links and are pivotable with respect to each other about a plurality of mutually parallel vertical or horizontal axes, such that the holder device is variable in shape, so that a variation of the shape of the holder device allows for the variation of the shape of the display area, characterized in that the holder device holds the display elements only at a first end of the latter.

2. The display device of claim 1, wherein the holder device is arranged only on a first side of the display elements that is situated at the first end of the display elements.

3. The display device of claim 1, wherein the connecting devices are formed as connecting hinges.

4. The display device of claim 1, wherein the holder elements of the holder device are hingedly connected by the connecting devices such that the holder elements are pivotable about a first, preferably vertical axis and/or a second, preferably horizontal axis.

5. The display device of claim 1, wherein the display elements are held in the holder device by a catch device.

6. The display device of claim 1, wherein support elements are used to connect the display elements with the holder device, in particular with the holder elements of the holder device.

7. The display device of claim 1, wherein a control device and/or a voltage supply device are arranged in a housing of the holder device.

8. The display device of claim 1, wherein the connecting devices have first and second connecting projections for connecting the holder elements, said connecting projections being formed in particular as parts of the holder elements.

9. The display device of claim 1, wherein the holder device has a overlapping portion in the connection portion of two adjacent holder elements, the second connecting projection of a first holder element and the first connecting projection of a second holder element overlapping in this overlapping portion.

10. The display device of claim 1, wherein the connecting hinge is formed by the second connecting projection of a respective first holder element and the first connecting portion of a respective second holder element, a pivot axis extending in particular through the second and first connecting projections of two adjacent holder elements, about which pivot axis the two adjacent holder elements may be pivoted with respect to each other.

11. The display device of claim 10, wherein the pivot axis extends in a vertical direction.

12. The display device of claim 1, wherein the holder device is arranged above the display elements, seen in the direction of gravity, so that the display elements are suspended from the holder device.

13. The display device of claim 1, wherein the holder device is arranged below the display elements, seen in the direction of gravity, so that the display elements are placed upright in the holder device.

14. The display device of claim 1, wherein the illuminants comprise LED's or LED cluster.

15. The display device of claim 5, wherein the catch device is configured in particular as a six-pole XLR connection.

16. The display device of claim 1, wherein the display elements comprise display element segments, wherein particular a plurality of display element segments form a display element.

17. The display device of claim 16, wherein the ends of the display element segments are provided with plug devices for a detachable electric and/or mechanic connection among the display element segments.

18. The display device of claim 1, wherein the illuminants of the display elements are provided on a circuit board.

19. The display device of claim 18, wherein the illuminants are spaced equidistantly on the circuit board.

20. The display device of claim 19, wherein the circuit board is severable between two adjacent illuminants so that the display elements are variable in length.

21. The display device of claim 20, wherein instead of the severed circuit board section, a plug device for a detachable electric and/or mechanic connection with an adjacent display element segment is provided, wherein the regular distances between the illuminants remain unaltered.

22. A display device for presenting optic content, comprising:

a plurality of display elements (14), wherein a first side of the display elements forms a first display area and a second side of the display elements forms a second display area, wherein particular the direction for viewing the first display area is opposite to the direction for viewing the second display area.

23. A display device for presenting optic content, comprising:

a holder device and a plurality of rod-shaped display elements, said display elements comprising a plurality of illuminants, wherein the display elements are held by the holder device and a display area for presenting the optic content is formed by the plurality of display elements, wherein the holder device comprises a plurality of holder elements interconnected by connecting devices such that the holder device is variable in shape and has an overlapping portion in the connection portion of two adjacent holder elements, the second connecting projection of a first holder element and the first connecting projection of a second holder element overlapping in this overlapping portion, so that a variation of the shape of the holder device allows for the variation of the shape of the display area, characterized in that the holder device holds the display elements only at a first end of the latter.

24. A display device for presenting optic content, comprising:

a holder device and a plurality of rod-shaped display elements, said display elements comprising a plurality of illuminants on a plug device for a detachable electric and/or mechanic connection with an adjacent display element segment, wherein the regular distances between the illuminants remain unaltered, wherein the display elements are held by the holder device and a display area for presenting the optic content is formed by the plurality of display elements, wherein the holder device comprises a plurality of holder elements interconnected by connecting devices such that the holder device is variable in shape, so that a variation of the shape of the holder device allows for the variation of the shape of the display area, characterized in that the holder device holds the display elements only at a first end of the latter.

* * * * *